US006745900B2

(12) United States Patent
Lambert

(10) Patent No.: US 6,745,900 B2
(45) Date of Patent: Jun. 8, 2004

(54) CASE WITH A FOLDABLE LID

(75) Inventor: Claude Lambert, Saint-Cloud (FR)

(73) Assignee: Qualipac (FR)

( * ) Notice: Subject to any disclaimer, the term of this patent is extended or adjusted under 35 U.S.C. 154(b) by 0 days.

(21) Appl. No.: 10/247,872

(22) Filed: Sep. 20, 2002

(65) Prior Publication Data

US 2003/0057127 A1 Mar. 27, 2003

(30) Foreign Application Priority Data

Sep. 21, 2001 (FR) ..... 01 12207

(51) Int. Cl.[7] ..... B65D 69/00
(52) U.S. Cl. ..... 206/581; 206/823
(58) Field of Search ..... 206/581, 751, 206/752, 755, 756, 45.2, 45.23; 220/831, 832, 833, 834, 324, 326, 837, 839

(56) References Cited

U.S. PATENT DOCUMENTS 4,741,441 A * 5/1988 Keffeler ..... 206/532
5,220,999 A 6/1993 Goulette
5,292,000 A 3/1994 Levy
5,823,353 A * 10/1998 Perrin et al. ..... 206/752
5,927,487 A * 7/1999 Whittle et al. ..... 206/45.2
6,131,740 A * 10/2000 Huang ..... 206/759
6,158,607 A 12/2000 Wallberg
6,454,115 B1 * 9/2002 Allasia ..... 220/4.23
6,591,985 B2 * 7/2003 Lai ..... 206/373

FOREIGN PATENT DOCUMENTS

DE 1096282 B 12/1960

* cited by examiner

*Primary Examiner*—Shian Luong
(74) *Attorney, Agent, or Firm*—Skinner and Associates

(57) ABSTRACT

Case comprising a base, a lid and a tongue connecting the lid to the base. The lid is movable between a closed position in which a reservoir arranged in the base is substantially isolated from the outside and an open position in which the lid is folded down under the base.

7 Claims, 2 Drawing Sheets

CASE WITH A FOLDABLE LID

BACKGROUND OF THE INVENTION

The invention relates to a case, in particular for cosmetic products.

Numerous cases are already known of the type comprising:

a base having a recessed region forming a reservoir, a lid, a tongue having two opposite ends, one being connected to the base and the other being connected to the lid, first retaining means having a first portion arranged on the base and a second portion arranged on the lid, which portions are to cooperate with one another to keep the lid, relative to the base, in a closed position in which the reservoir is substantially isolated from the outside.

BRIEF SUMMARY OF THE INVENTION

The invention aims more especially to propose a simple and very inexpensive case which enables the cosmetic product to be preserved without deterioration but which is nevertheless particularly practical to use and which can satisfy a very wide-ranging clientele.

To that end, the invention proposes that the device also comprises second retaining means having a first portion arranged on the base and a second portion arranged on the lid, which portions are to cooperate with one another to keep the lid, relative to the base, in an open position permitting free access to the reservoir, the tongue being of a length such that, while remaining connected to the base and to the lid, it enables the lid to be moved between the closed position and the open position.

Thus, there is no need for relatively expensive means for the articulation of the lid relative to the base, such as a friction hinge or another analogous device, in order to keep the lid at a distance from the reservoir. In addition, there is no risk that the lid will be mislaid. Such a case can be used both for conventional personal use and as a display means for a demonstration sample which will be discarded when the quantity of cosmetic product has been exhausted.

Advantageously, the case has the following supplementary features:

the base has an upper portion and a lower portion, the upper portion incorporating the first portion of the first retaining means and the lower portion incorporating the first portion of the second retaining means, the lid has an upper portion and a lower portion, the lower portion incorporating the second portion of the first retaining means and the upper portion incorporating the second portion of the second retaining means, the reservoir is arranged in the upper portion of the base, the open and closed positions of the lid are parallel with one another.

Thus, the lid can be folded down under the base, which is especially practical and requires little space. Furthermore, several identical cases can be superposed and thus readily stored or transported in the form of stacks of cases nested inside one another.

According to another advantageous feature, the invention proposes that:

the upper portion of the lid has a substantially cylindrical outer surface having a specific cross-section and defining the second portion of the second retaining means, the base has, in the lower portion, a recess delimited by a substantially cylindrical inner surface which defines the first portion of the second retaining means and has a cross-section substantially identical to the cross-section of the second portion of the second retaining means, in order to receive that second portion tightly.

Such retaining means are particularly simple, inexpensive, sturdy and easy to use.

In order to increase the retaining depth without complicating the moulding of the case, the invention proposes that the lower portion of the base be indented in the vicinity of the connecting region between the base and the tongue, the tongue passing through the indentation so formed when the lid is in the open position.

In order further to improve the case and in particular the isolation of the reservoir in the closed position, the invention proposes that:

the upper portion of the base has a substantially cylindrical outer surface having a specific cross-section and defining the first portion of the first retaining means, the lid has, in the lower portion, a recess delimited by a substantially cylindrical inner surface which defines the second portion of the first retaining means and has a cross-section substantially identical to the cross-section of the first portion of the first retaining means, in order to receive that first portion tightly, and the first retaining means incorporate sealing means defined by a peripheral boss formed on the first portion of the first retaining means and a groove of complementary shape formed in the second portion of the first retaining means.

Thus, good sealing of the case can be obtained in the closed position at reasonable cost. The boss and the groove also reinforce the holding of the lid in the closed position.

The invention also proposes that the device comprises a cup placed inside the reservoir of the base.

That enables the case to be refilled with cosmetic product in a simple manner by changing the cup without changing the case.

BRIEF DESCRIPTION OF THE SEVERAL VIEWS OF THE DRAWINGS

The invention will emerge even more clearly from the following description which is given with reference to the appended drawings in which.

DETAILED DESCRIPTION OF THE INVENTION

Figure 1:
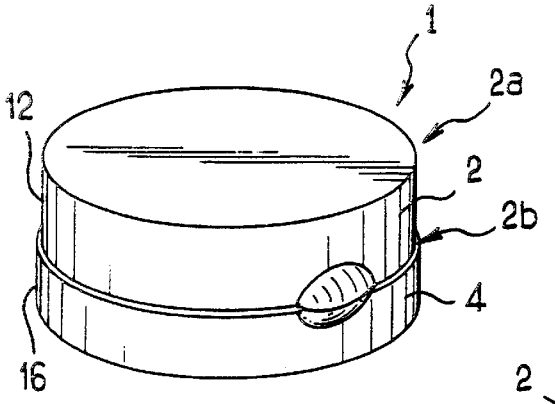
FIG. 1 illustrates a case according to the invention in the closed position in three-quarter front perspective.

FIGS. 1 to 6 illustrate a case 1 basically comprising a base 4, a lid 2 and a tongue 6 which are moulded together in a single piece.

The lid 2 comprises a lower portion 2*b* and an upper portion 2*a* which is narrower than the lower portion. The lid has an outer surface 12 which is substantially cylindrical, in this case having a circular cross-section, and which extends in particular in the upper portion 2*a*, and an inner surface 14 which is substantially cylindrical, in this case having a circular cross-section, and which extends in particular in the lower portion 2*b*. The inner surface 14 of the lid 2 also incorporates, in the lower portion 2*b*, a peripheral groove 20 (see in particular FIG. 6).

The base 4 comprises an upper portion 4*a* having a substantially cylindrical outer surface 16 of circular cross-section and a lower portion 4*b* having an inner surface 18 and an outer surface 30 which are substantially cylindrical and of circular cross-section. The base 4 also comprises, between the upper portion 4*a* and the lower portion 4*b*, a substantially flat plate 10 which extends radially and defines in the upper portion 4*a*, in a recessed region, a reservoir 24 which is to receive a cup 8 which is filled with cosmetic product and which rests on the plate 10. In addition, the outer surface 16 of the base 4 incorporates a peripheral boss 22, which is generally referred to as beading.

Figure 2:
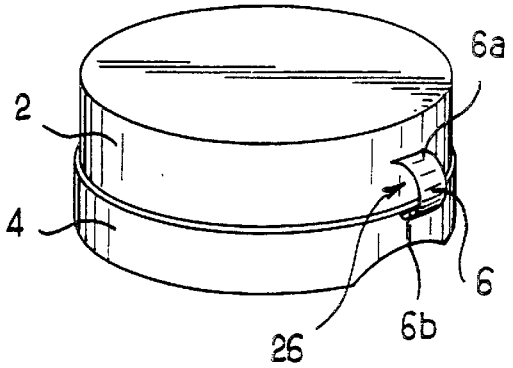
FIG. 2 illustrates the case of FIG. 1 in three-quarter rear perspective.
Figure 5:
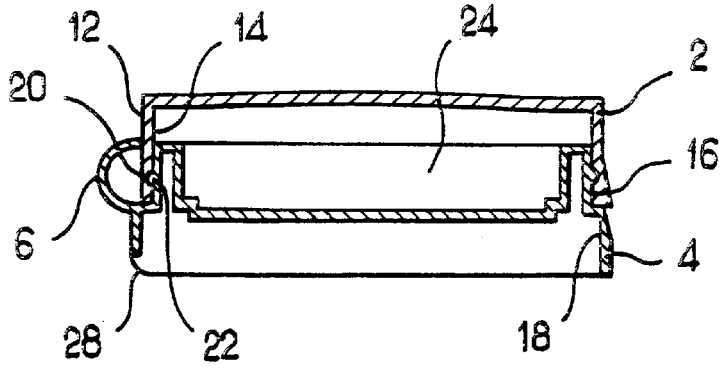
FIG. 5 illustrates the case of FIG. 1 in cross-section, in the closed position.

The outer surface 16 of the base 4 has a diameter which is substantially equal to, and even slightly larger than, the diameter of the inner surface 14 of the lid 2, in order to insert tightly the upper portion 4*a* of the base, under slight resilient deformation, inside the lower portion 2*b* of the lid. The case is then in a closed position of the case 1, as illustrated in FIGS. 1, 2 and 5, in which the base and the lid nest in one another under slight retaining constraint, the lid then covering the reservoir 24.

In that closed position, the beading 22 is inserted tightly into the groove 20 having shapes complementing those of the beading, in order to improve sealing between the inner surface 14 of the lid 2 and the outer surface 16 of the base 4 and therefore the isolation of the reservoir 24 from the outside air.

The tongue 6 is pliable and has one end 6*a* fixed to the outer surface 12 of the lid 2 and an opposite end 6*b* fixed to the outer surface 30 of the base 4 in a fixing region 26. It is sufficiently long to enable the user to raise the lid 2 relative to the base 4, to cause it to pivot and to bring it below the base 4, while keeping the lid 2 and the base 4 together.

Figure 3:
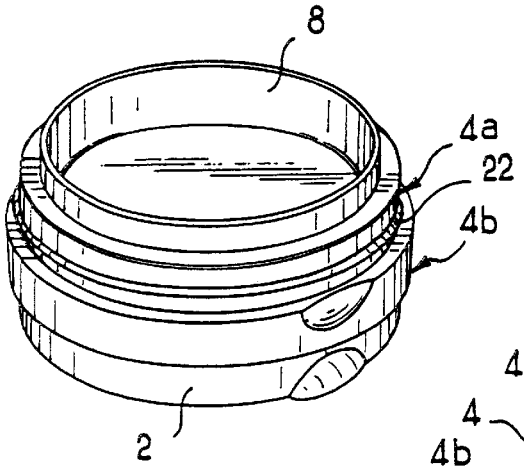
FIG. 3 illustrates the case of FIG. 1 in the open position in three-quarter front perspective.
Figure 4:
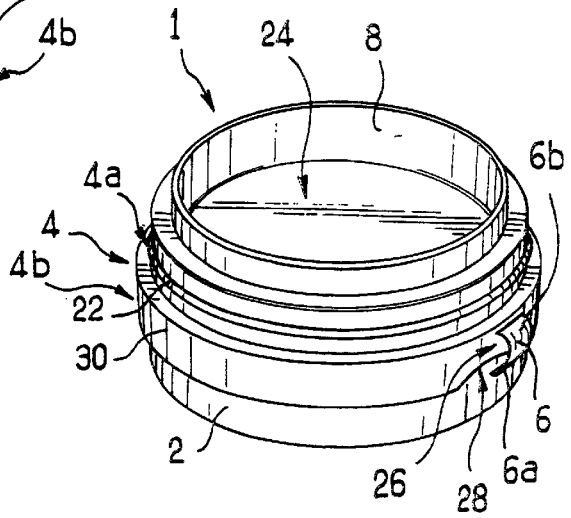
FIG. 4 illustrates the case of FIG. 1 in the open position in three-quarter rear perspective.
Figure 6:
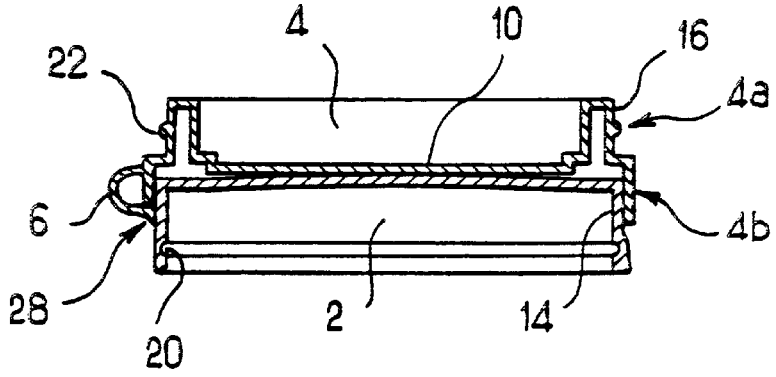
FIG. 6 illustrates the case of FIG. 1 in cross-section, in the open position.

The outer surface 12 of the lid 2 has a diameter which is substantially equal to, and even slightly larger than, the diameter of the inner surface 18 of the base 4, in order to insert tightly, under slight resilient deformation, the upper portion 2*a* of the lid inside the lower portion 4*b* of the base. The case is then in an open position, as illustrated in FIGS. 3, 4 and 6, in which the lid and the base nest in one another under slight retaining constraint, the lid 2 being folded beneath the plate 10. The closed and open positions of the lid 2 are substantially parallel with one another and are offset in a direction which is substantially vertical and perpendicular to the plane of the plate 10.

As illustrated in FIG. 4, the outer surface 16 of the base 4 has an indentation 28 in the vicinity of the fixing region 26 at the lower end of the lower portion 4*b* of the base, in order to permit the passage of the tongue 6.

Figure 7:
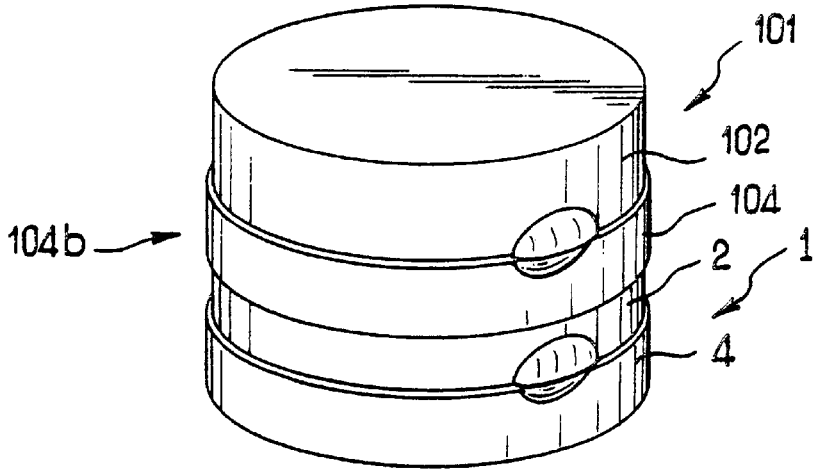
FIG. 7 illustrates two identical superposed cases similar to that in FIG. 1, in three-quarter front perspective.

FIG. 7 illustrates a second case 101 which is identical to that described above and the corresponding elements of which bear a reference increased by 100. The case 101 is stacked on the case 1, the upper portion 2*a* of the lid 2 of the case 1 nesting in the lower portion 104*b* of the base 104 of the case 101.

The case is moulded preferably by the injection under pressure of thermoplastic material which is advantageously constituted by high-density polyethylene (HDPE) or polypropylene (PP).

What is claimed is:

1. A case, in particular for a cosmetic product, comprising:

a base having a recessed region forming a reservoir, a lid, a tongue having two opposite ends, one being connected to the base and the other being connected to the lid, first retaining means having a first portion arranged on the base and a second portion arranged on the lid, which portions are to cooperate with one another to keep the lid, relative to the base, in a closed position in which the reservoir is substantially isolated from the outside, second retaining means having a first portion arranged on the base and a second portion arranged on the lid, which portions are to cooperate with one another to keep the lid, relative to the base, in an open position permitting free access to the reservoir, the tongue being of a length such that, while remaining connected to the base and to the lid, it enables the lid to be moved between the closed position and the open position, the base has an upper portion and a lower portion, the upper portion incorporating the first portion of the first retaining means and the lower portion incorporating the first portion of the second retaining means, the lid has an upper portion and a lower portion, the lower portion incorporating the second portion of the first retaining means and the upper portion incorporating the second portion of the second retaining means, the open and closed positions of the lid are parallel with one another.

2. A case according to claim 1, wherein:

the reservoir is arranged in the upper portion of the base.

3. A case according to claim 2, wherein:

the upper portion of the lid has a substantially cylindrical outer surface having a specific cross-section and defining the second portion of the second retaining means, the base has, in the lower portion, a recess delimited by a substantially cylindrical inner surface which defines the first portion of the second retaining means and has a cross-section substantially identical to the cross-section of the second portion of the second retaining means, in order to receive that second portion tightly.

4. A case according to claim 3, wherein the lower portion of the base is indented in the vicinity of the connecting region between the base and the tongue.

5. A case according to claim 3, wherein the outer surface of the upper portion of the lid and the inner surface of the lower portion of the base have a circular cross-section.

6. A case according to claim 2, wherein:

the upper portion of the base has a substantially cylindrical outer surface having a specific cross-section and defining the first portion of the first retaining means, the lid has, in the lower portion, a recess delimited by a substantially cylindrical inner surface which defines the second portion of the first retaining means and has a cross-section substantially identical to the cross-section of the first portion of the first retaining means, in order to receive that first portion tightly, and p1 the first retaining means incorporate sealing means defined by a peripheral boss formed on the first portion of the first retaining means and a groove of complementary shape formed in the second portion of the first retaining means.

7. A case according to claim 1, which also comprises a cup placed inside the reservoir of the base.

* * * * *